US008760371B2

(12) United States Patent
Murakawa

(10) Patent No.: US 8,760,371 B2
(45) Date of Patent: Jun. 24, 2014

(54) PLASMA DISPLAY APPARATUS USING DRIVE CIRCUIT

(75) Inventor: Shinichi Murakawa, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 333 days.

(21) Appl. No.: 12/962,392

(22) Filed: Dec. 7, 2010

(65) Prior Publication Data

US 2011/0134095 A1 Jun. 9, 2011

(30) Foreign Application Priority Data

Dec. 8, 2009 (JP) ..... 2009-278867

(51) Int. Cl.
*G09G 3/28* (2013.01)
*G09G 5/00* (2006.01)

(52) U.S. Cl.
USPC ..... 345/60; 345/211; 327/108

(58) Field of Classification Search
USPC ..... 345/60, 211; 327/108
See application file for complete search history.

(56) References Cited

U.S. PATENT DOCUMENTS 6,057,726 A * 5/2000 Sumida ..... 327/333
6,864,736 B2 * 3/2005 Guedon et al. ..... 327/333
2005/0195179 A1 * 9/2005 Kobayashi et al. ..... 345/204
2006/0044041 A1 * 3/2006 Maeda et al. ..... 327/333
2008/0191973 A1 * 8/2008 Rhee ..... 345/67
2008/0246529 A1 * 10/2008 Hishikawa et al. ..... 327/333
2009/0219074 A1 * 9/2009 Kwon ..... 327/333

FOREIGN PATENT DOCUMENTS

JP 2006-101490 A 4/2006

* cited by examiner

*Primary Examiner* — Jonathan Boyd
(74) *Attorney, Agent, or Firm* — Sughrue Mion, PLLC

(57) ABSTRACT

A drive circuit includes: first and second P-channel MOS transistors connected with a first voltage; a first N-channel MOS transistor connected between the first P-channel MOS transistor and a ground voltage, and having a gate connected with a first node and configured to receive a first input signal; and a second N-channel MOS transistor connected between the second P-channel MOS transistor and the ground voltage and having a gate connected with a second node and configured to receive a second input signal. An output P-channel MOS transistor is connected between the first voltage and an output node and has a gate connected with the second node, and an output N-channel MOS transistor is connected between the output node and the second voltage and has a gate supplied with an input signal having a same polarity as that of the first input signal. A P-channel MOS transistor has a source connected with the first node, a drain connected with the output node, and a gate connected with the second node.

7 Claims, 8 Drawing Sheets

PLASMA DISPLAY APPARATUS USING DRIVE CIRCUIT

INCORPORATION BY REFERENCE

This patent application claims a priority on convention based on Japanese Patent Application No. 2009-278867. The disclosure thereof is incorporated herein by reference.

TECHNICAL FIELD

The present invention is related to a drive circuit to perform on/off control of a high breakdown voltage P-channel FET (Field Effect Transistor).

BACKGROUND ART

FIG. 1 shows a configuration of a conventional drive circuit shown in Patent Literature 1 (Japanese Patent Publication (JP 2006-101490A)). A first power supply NVDDH and a second power supply NVDDL are connected to the drive circuit, to supply a first voltage VDDH, and a second voltage VDDL lower than the first voltage VDDH, and a ground voltage GND is also connected to the drive circuit.

The conventional drive circuit is provided with a low voltage control section 113, a level shift section 111 and a buffer section 112.

The low voltage control section 113 is connected between the second voltage NVDDL and the ground voltage GND. The low voltage control section 113 uses the third voltage VDDL as a power supply voltage.

The level shift section 111 is provided with P-channel MOS transistors MP101 and MP102, and N-channel MOS transistors MN101 and MN102. The P-channel MOS transistor MP101 and MP102 are connected with the first voltage VDDH. The N-channel MOS transistor MN101 is connected between the P-channel MOS transistor MP101 and the ground voltage GND, and a first input signal IN1 is supplied to a gate of the N-channel MOS transistor MN101. A gate of the P-channel MOS transistor MP102 is connected with a first node A101 between the P-channel MOS transistor MP101 and the N-channel MOS transistor MN101. The N-channel MOS transistor MN102 is connected between the P-channel MOS transistor MP102 and the ground voltage GND, and a second input signal IN2 is supplied to a gate of the transistor MN102. A gate of the P-channel MOS transistor MP101 is connected with a second node B101 between the P-channel MOS transistor MP102 and the N-channel MOS transistor MN102.

The buffer section 112 is provided with a push-pull output P-channel MOS transistor MP103 and a push-pull output N-channel MOS transistor MN103. The P-channel MOS transistor MP103 is connected between the first voltage VDDH and an output node OUT, and a gate thereof is connected with second node B101. The N-channel MOS transistor MN103 is connected between the output node OUT and the ground voltage GND, and a third input signal IN3 is supplied to a gate thereof.

The buffer section 112 performs a switching operation in response to a signal of the second node B101 and the third input signal IN3 from the low voltage control section 113.

FIG. 2 shows an operation in a first mode and a second mode in the conventional drive circuit.

When the signal level of the input signal IN is a high level, the low voltage control section 113 executes the first mode.

The low voltage control section 113 sets signal levels of first to third input signals IN1 to IN3 to a low level, a high level and a low level in the first mode.

In this case, the N-channel MOS transistor MN102 is turned on in response to the second input signal IN2 of the high level. Simultaneously, the N-channel MOS transistor MN101 is turned off in response to the first input signal IN1 of the low level. The P-channel MOS transistor MP103 is turned on in response to a signal of the second node B101 (a second output signal) of the low level. The P-channel MOS transistor MP102 is turned off in response to a signal at the first node A101 (a first output signal) of the high level. At this time, since the voltage of the second node B101 falls to the ground voltage GND, the P-channel MOS transistor MP101 is turned on. Thus, the voltage of the output node OUT is raised to the first voltage VDDH. Also, the N-channel MOS transistor MN103 is turned off in response to the third input signal IN3 of the low level, so that the level of the input signal IN is converted and is supplied to the output node OUT.

On the other hand, when the input signal IN is in the low level, the low voltage control section 113 executes the second mode. The low voltage control section 113 sets the signal levels of the first to third input signals IN1 to IN3 to the high level, the low level and the high level in the second mode, respectively.

In this case, since the N-channel MOS transistor MN101 is turned on in response to the first input signal IN1 of the high level so that the voltage of the first node A101 falls to the ground voltage GND. The P-channel MOS transistor MP102 is turned on in response to the first output signal of the low level. Simultaneously, the N-channel MOS transistor MN102 is turned off in response to the second input signal IN2 of the low level. Thus, since the voltage of the second node B101 is raised to the first voltage VDDH, the P-channel MOS transistor MP103 is turned off. Moreover, the N-channel MOS transistor MN103 is turned on in response to the third input signal IN3 of the high level, so that the voltage of the output node OUT falls to the ground voltage GND.

CITATION LIST

[Patent Literature 1]: JP 2006-101490A

SUMMARY OF THE INVENTION

It is supposed that the voltage of the output node OUT is rapidly reduced from the first voltage VDDH to the ground voltage GND due to any fault such as a short-circuit in the first mode.

In this case, since the P-channel MOS transistor MP103 maintains an on-state, a large amount of current continues to flow from the first voltage VDDH to the P-channel MOS transistor MP103. The P-channel MOS transistor MP103 itself generates heat due to the large amount of current (short-circuit current). As a result, the breakdown voltage of the P-channel MOS transistor MP103 falls and the P-channel MOS transistor MP103 is broken with the heat.

In an aspect of the present invention, a drive circuit includes: first and second P-channel MOS transistors connected with a first voltage; a first N-channel MOS transistor connected between the first P-channel MOS transistor and a second voltage which is lower than the first voltage, and having a gate configured to receive a first input signal, wherein a gate of the second P-channel MOS transistor is connected with a first node between the first P-channel MOS transistor and the first N-channel MOS transistor; a second N-channel MOS transistor connected between the second P-channel MOS transistor and the second voltage and having a gate configured to receive a second input signal, wherein a gate of the first P-channel MOS transistor is connected with a second node between the second P-channel MOS transistor and the second N-channel MOS transistor; an output P-channel MOS transistor connected between the first voltage and an output node and having a gate connected with the second node; an output N-channel MOS transistor connected between the output node and the second voltage and having a gate supplied with an input signal having a same polarity as that of the first input signal; and a P-channel MOS transistor having a source connected with the first node, a drain connected with the output node, and a gate connected with the second node.

In another aspect of the present invention, a plasma display apparatus includes: a plurality of discharge electrode pairs, wherein one of each of the plurality of discharge electrode pairs is a maintenance electrode and the other is a scan electrode; a plurality of data electrodes provided to oppose to the plurality of discharge electrode pairs wherein display cells are formed at intersections of the plurality of discharge electrode pairs and the plurality of data electrodes; a scan driver configured to drive the plurality of scan electrodes; a maintenance driver configured to drive the plurality of maintenance electrodes; and a data driver configured to drive the plurality of data electrodes. The data driver includes: an output control section configured to output a data pulse signal determined based on image data in an address period; and a drive circuit provided for each of the plurality of data electrodes. The drive circuit includes: first and second P-channel MOS transistors connected with a first voltage; a first N-channel MOS transistor connected between the first P-channel MOS transistor and a second voltage which is lower than the first voltage, and having a gate configured to receive a first input signal, wherein a gate of the second P-channel MOS transistor is connected with a first node between the first P-channel MOS transistor and the first N-channel MOS transistor; a second N-channel MOS transistor connected between the second P-channel MOS transistor and the second voltage and having a gate configured to receive a second input signal, wherein a gate of the first P-channel MOS transistor is connected with a second node between the second P-channel MOS transistor and the second N-channel MOS transistor; an output P-channel MOS transistor connected between the first voltage and an output node and having a gate connected with the second node; an output N-channel MOS transistor connected between the output node and the second voltage and having a gate supplied with an input signal having a same polarity as that of the first input signal; and a P-channel MOS transistor having a source connected with the first node, a drain connected with the output node, and a gate connected with the second node. The first and second input signals are generated based on the data pulse signal as an input signal.

According to the drive circuit of the present invention, when the voltage of the output node OUT is rapidly reduced from the first voltage VDDH to the ground voltage GND due to any fault such as a short circuit, a P-channel MOS transistor MP4 is provided between a first node A1 and an output node OUT for short-circuit current prevention. The voltage of the first node A1 and the voltage of the output node OUT are reduced at the same time and the P-channel MOS transistor MP2 is turned on. Thus, the P-channel MOS transistor MP3 is turned off. As a result, the voltage of the output node OUT is stable at the ground voltage GND and can prevent the destruction of the P-channel MOS transistor MP3.

According to the drive circuit of the present invention, the low voltage control section executes a first mode, and then a third mode. Thus, a pass-through current does not flow between the P-channel MOS transistor MP2 and the N-channel MOS transistor MN2 in addition to above-described effect.

BRIEF DESCRIPTION OF THE DRAWINGS

The above and other objects, advantages and features of the present invention will be more apparent from the following description of certain embodiments taken in conjunction with the accompanying drawings, in which.

DESCRIPTION OF EMBODIMENTS

Hereinafter, a drive circuit according to the present invention will be described with reference to the attached drawings. For example, the drive circuit according to an embodiment of the present invention is applied to a data driver of a plasma display apparatus.

Figure 1:
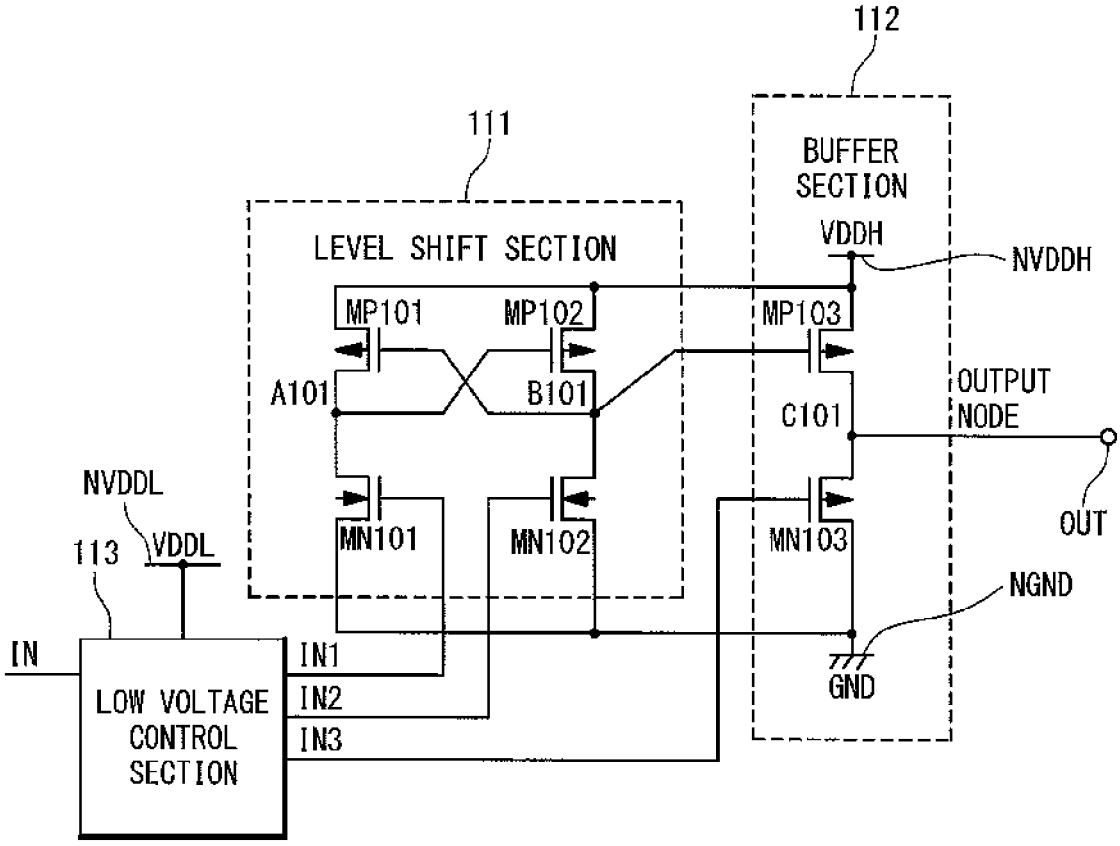
Fig. 1 CONVENTIONAL ART
FIG. 1 is a block diagram showing a configuration of a conventional drive circuit.
Figure 2:
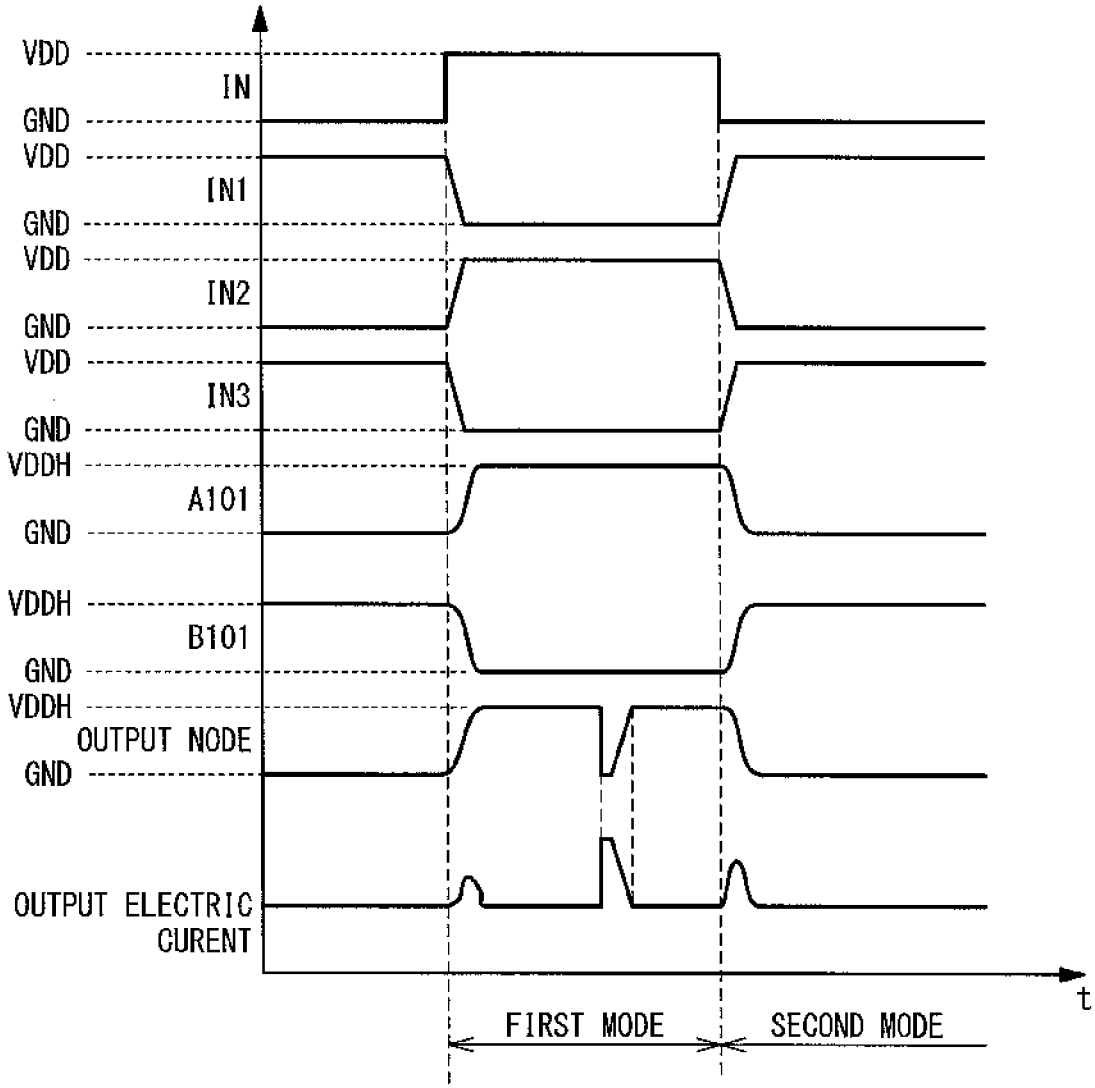
Fig. 2 CONVENTIONAL ART
FIG. 2 shows timing charts of the operation of the conventional drive circuit in two modes.
Figure 3:
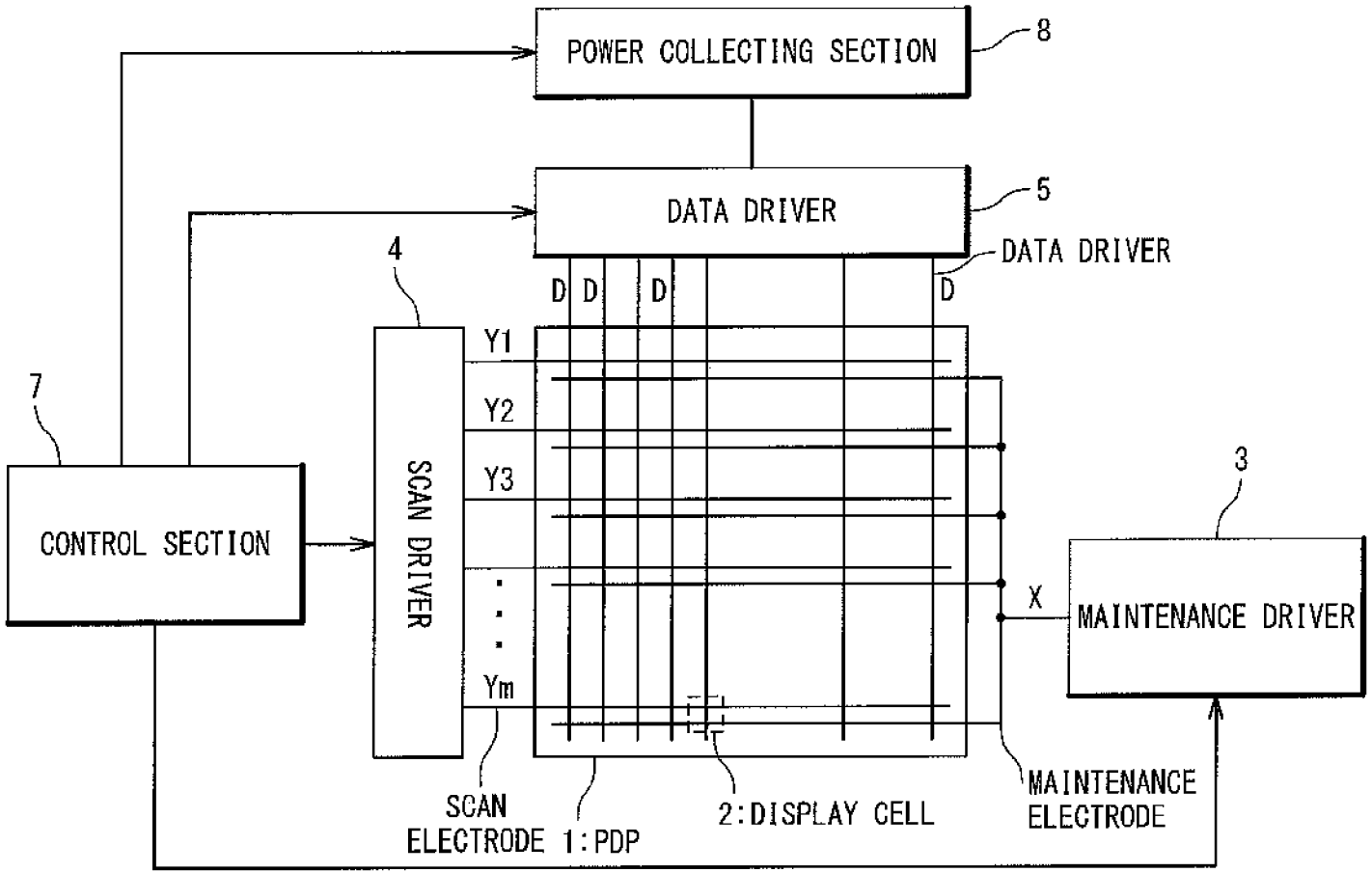
FIG. 3 shows a configuration of a plasma display apparatus.

FIG. 3 shows the configuration of the plasma display apparatus.

The plasma display apparatus is provided with a plasma display panel (PDP) 1, a plurality of discharge electrode pairs and a plurality of data electrodes D. One discharge electrode of each of the plurality of discharge electrode pairs is a maintenance electrode X and the other discharge electrode thereof is a corresponding one of scan electrodes Y1 to Ym (m is an integer equal to or more than 2). The plurality of data electrodes D are arranged to oppose to the plurality of discharge electrode pairs and a display cell 2 as a capacitance element is provided in each of intersections of the plurality of discharge electrode pairs and the plurality of data electrodes. That is, when the number of data electrodes D is n (n is an integer equal to or more than 2), the plasma display panel 1 is provided with the display cells 2 in the matrix of m rows and n columns.

The plasma display apparatus is also provided with a scan driver 4 to drive the plurality of scan electrodes Y1 to Ym, a maintenance driver 3 to drive the plurality of maintenance electrodes X, a data driver 5 to drive the plurality of data electrodes D, and a control section 7 and a power collecting section 8.

Figure 4:
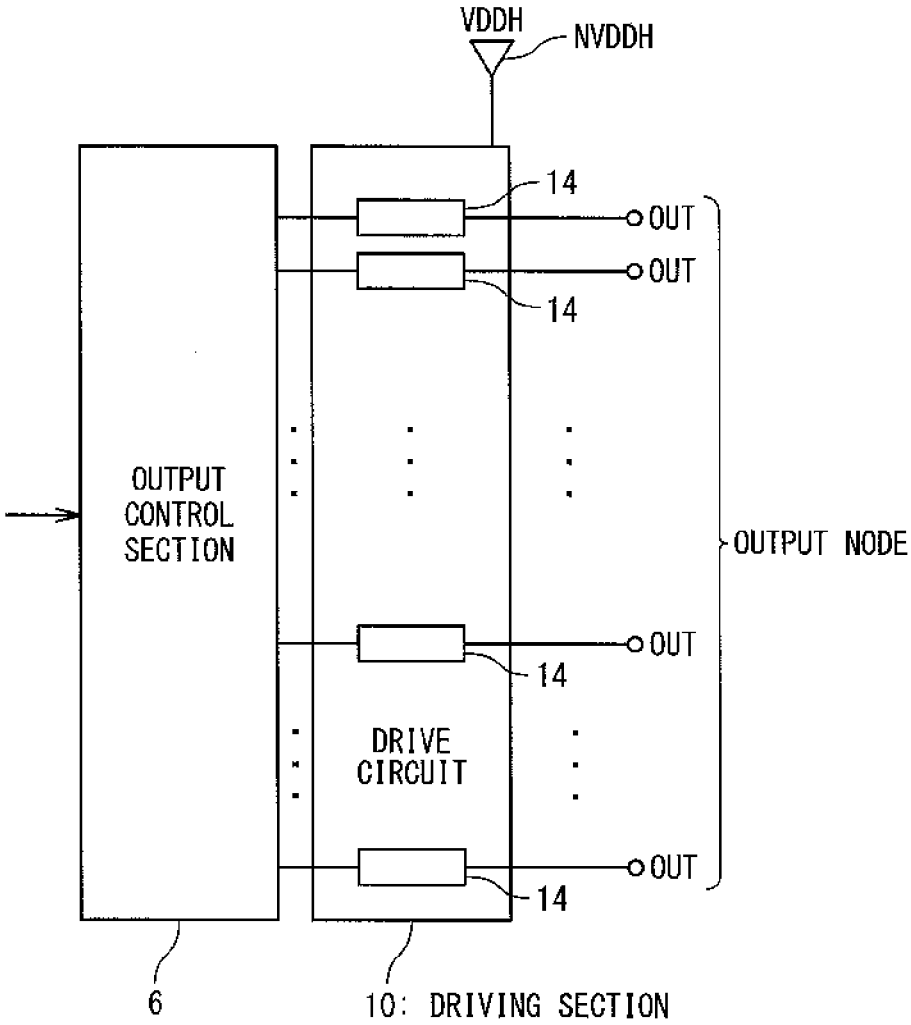
FIG. 4 is a block diagram showing a configuration of a data driver in FIG. 3.

FIG. 4 shows the configuration of the data driver 5 in FIG. 3. The first voltage VDDH is supplied to the data driver 5. The data driver 5 is provided with an output control section 6 and a driving section 10. The driving section 10 is provided with the plurality of drive circuits 14 (see FIG. 6) for the plurality of data electrode D, respectively. The outputs of the plurality of drive circuits 14 are connected with the data output nodes OUT which are connected with the plurality of data electrodes D, respectively. The plurality of drive circuits 14 are connected with the first voltage VDDH as the power supply voltage.

Figure 5:
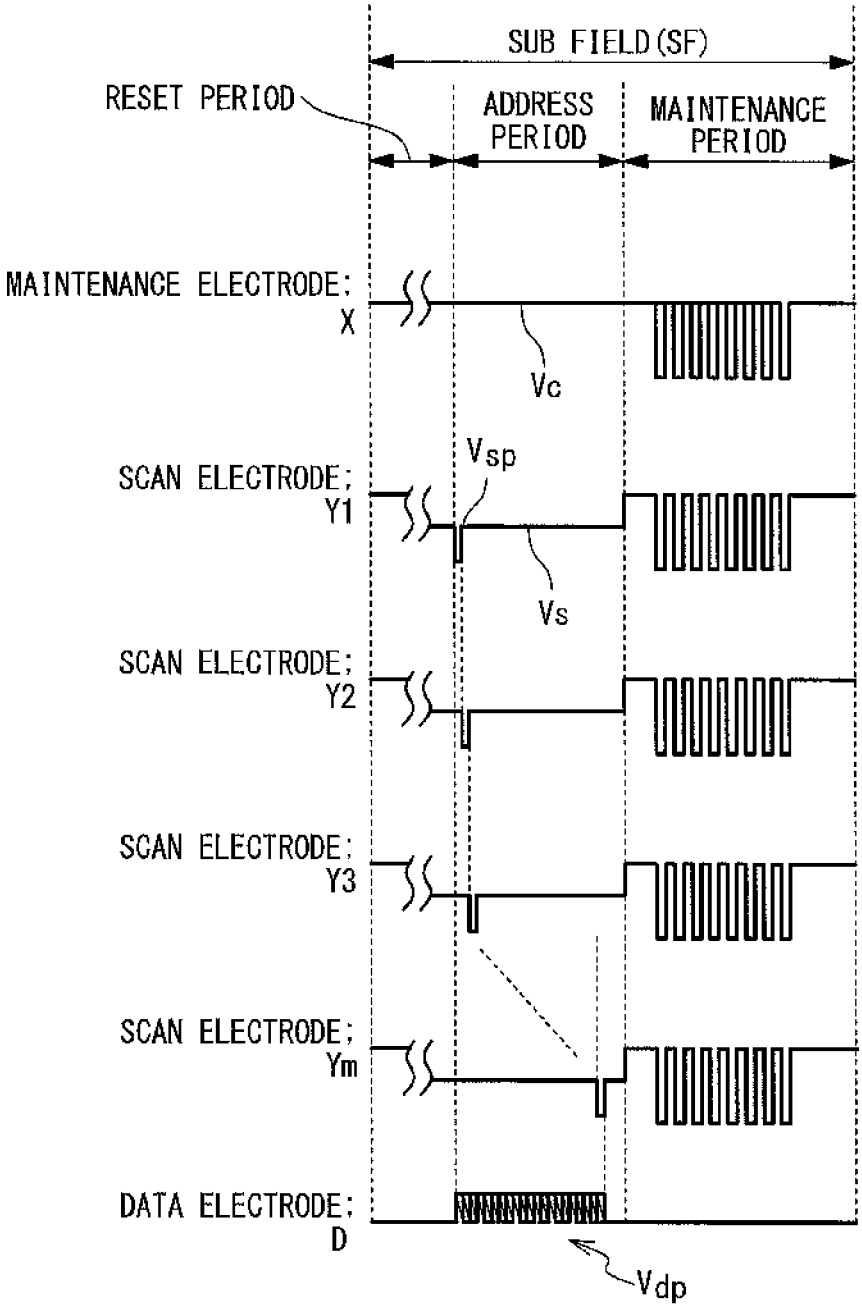
FIG. 5 shows timing charts of the operation of the plasma display apparatus.

FIG. 5 shows the operation of the plasma display apparatus. Here, one field or one subfield contains a reset period, an address period after the reset period and a maintenance period after the address period.

The control section 7 controls the maintenance driver 3 and the scan driver 4 in the reset period to supply voltages to the plurality of maintenance electrodes X and the plurality of scan electrodes Y1 to Ym so as to adjust amounts of electric charge between the plurality of maintenance electrodes X and the plurality of scan electrodes Y1 to Ym accumulated when maintenance discharge is carried out.

The control unit 7 controls the maintenance driver 3, the scan driver 4, and the data driver 5 in the address period to supply voltages to the plurality of maintenance electrodes X, the plurality of scan electrodes Y1 to Ym, and the plurality of data electrodes D so as to write image data in the display cells 2 through discharge between the plurality of scan electrodes Y1 to Ym and the plurality of data electrodes D. For example, the control section 7 controls the maintenance driver 3 to supply a first setting voltage Vc to the plurality of maintenance electrodes X. The control section 7 controls the scan driver 4 to supply second setting voltage Vs higher than the ground voltage GND to the plurality of scan electrodes Y1 to Ym. Then, the control section 7 controls the scan driver 4 to supply a scan pulse voltage Vsp which falls from the second setting voltage Vs to the ground voltage GND, to the plurality of scan electrodes Y1 to Ym in order from the first one to the last one. Thereafter, the control section 7 controls the data driver 5 to supply data pulse voltages Vdp to the plurality of data electrodes D based on image data for an image. At this time, in the data driver 5, first, the output control section 6 converts the data pulse voltages into data pulse voltages Vdp according to the image data under the control of the control section 7. Next, the plurality of drive circuits 14 convert voltage levels of the data pulse voltages Vdp into voltage levels adapted to write in the display cells 2 and outputs onto the plurality of data electrodes D.

Also, the control section 7 collects the electric charge (electric power) which is accumulated during light emission from the display cell 2, when the light emission from the display cell 2 is not carried out, and reuses the collected electric charge upon the next light emission from the display cells 2. Therefore, the control section 7 controls the power collecting section 8 to collect the electric charge accumulated by the display cells 2 in the address period.

The control section 7 controls the maintenance driver 3, and the scan driver 4 in the maintenance period, to supply voltages to the plurality of maintenance electrodes X and the plurality of scan electrodes Y1 to Ym so as to carry out maintenance discharge by which the display cells 2 subjected to write discharge emit light, between the plurality of scan electrodes Y1 to Ym and the plurality of maintenance electrodes X.

Figure 6:
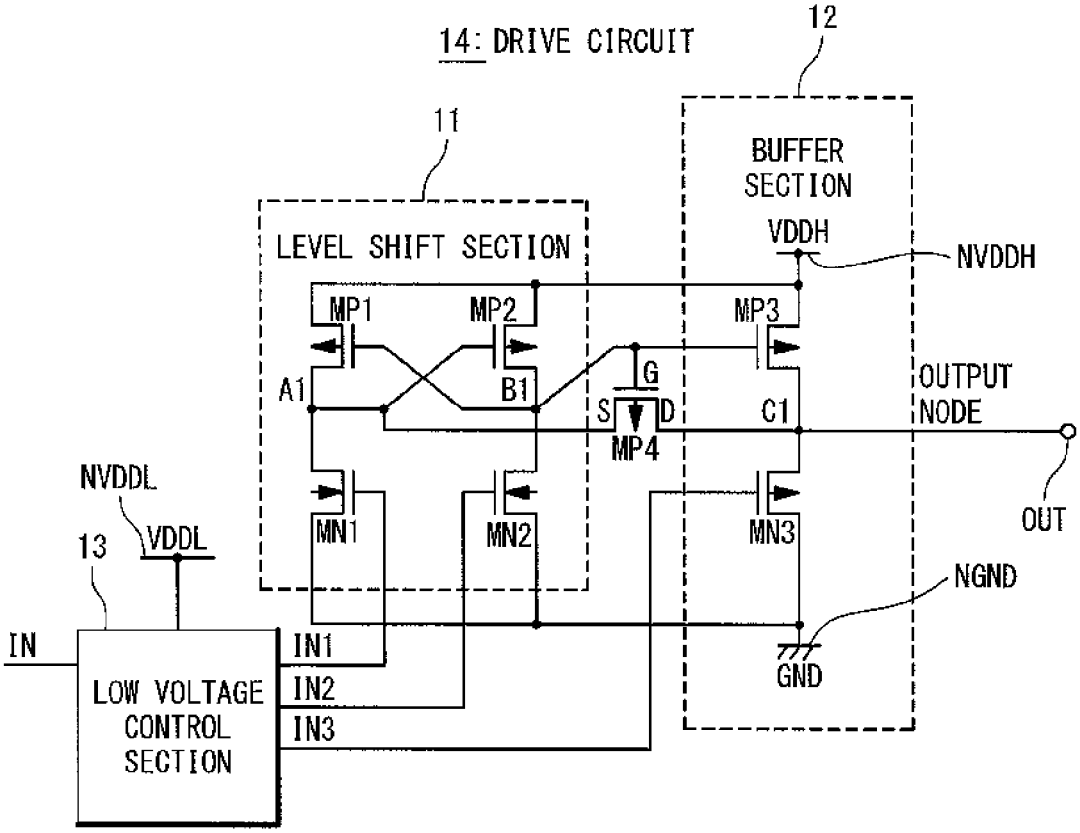
FIG. 6 is a block diagram showing a configuration of a drive circuit according to an embodiment of the present invention.

FIG. 6 is a circuit diagram showing a configuration of the drive circuit 14 according to the present embodiment of the present invention. A first voltage VDDH, a ground voltage GND, and a second voltage VDDL higher than the ground voltage GND and lower than the first voltage VDDH are connected with the drive circuit 14.

The drive circuit 14 is provided with the low voltage control section 13, a level shift section 11, a buffer section 12 and a P-channel MOS transistor MP4 for short-circuit current prevention.

The low voltage control section 13 is connected between the second voltage VDDL and the ground voltage GND. The low voltage control section 13 uses the second voltage VDDL as the power supply voltage. In response to an input signal IN, the low voltage control section 13 outputs first and second input signals IN1 and IN2 to the level shift section 11 and outputs a third input signal IN3 to the buffer section 12.

The level shift section 11 is provided with P-channel MOS transistors MP1 and MP2, and N-channel MOS transistors MN1 and MN2. The P-channel MOS transistors MP1 and MP2 are connected with the first voltage VDDH. The N-channel MOS transistor MN1 is connected between the P-channel MOS transistor MP1 and the ground voltage GND and the first input signal IN1 is supplied to a gate of the transistor MN1. A gate of the P-channel MOS transistor MP2 is connected with a first node A1 between the P-channel MOS transistor MP1 and the N-channel MOS transistor MN1. The N-channel MOS transistor MN2 is connected between the P-channel MOS transistor MP2 and the ground voltage GND and the second input signal IN2 is supplied to a gate of the N-channel MOS transistor MN2. A gate of the P-channel MOS transistor MP1 is connected with a second node B1 between the P-channel MOS transistor MP2 and the N-channel MOS transistor MN2.

The buffer section 12 is provided with a push-pull output P-channel MOS transistor MP3 and a push-pull output N-channel MOS transistor MN3. The P-channel MOS transistor MP3 is connected between the first voltage VDDH and the output node OUT and the gate thereof is connected with the second node B1. The N-channel MOS transistor MN3 is connected between the output node OUT and the ground voltage GND and the third input signal IN3 is supplied to a gate of the transistor MN3.

The buffer section 12 performs a switching operation based on a voltage at the second node B1 and the third input signal IN3 from the low voltage control section 13.

The P-channel MOS transistor MP4 for short-circuit current prevention has a source connected with the first node A1, a drain connected with a third node C1 as the output node OUT, and a gate connected with the second node B1.

Figure 7:
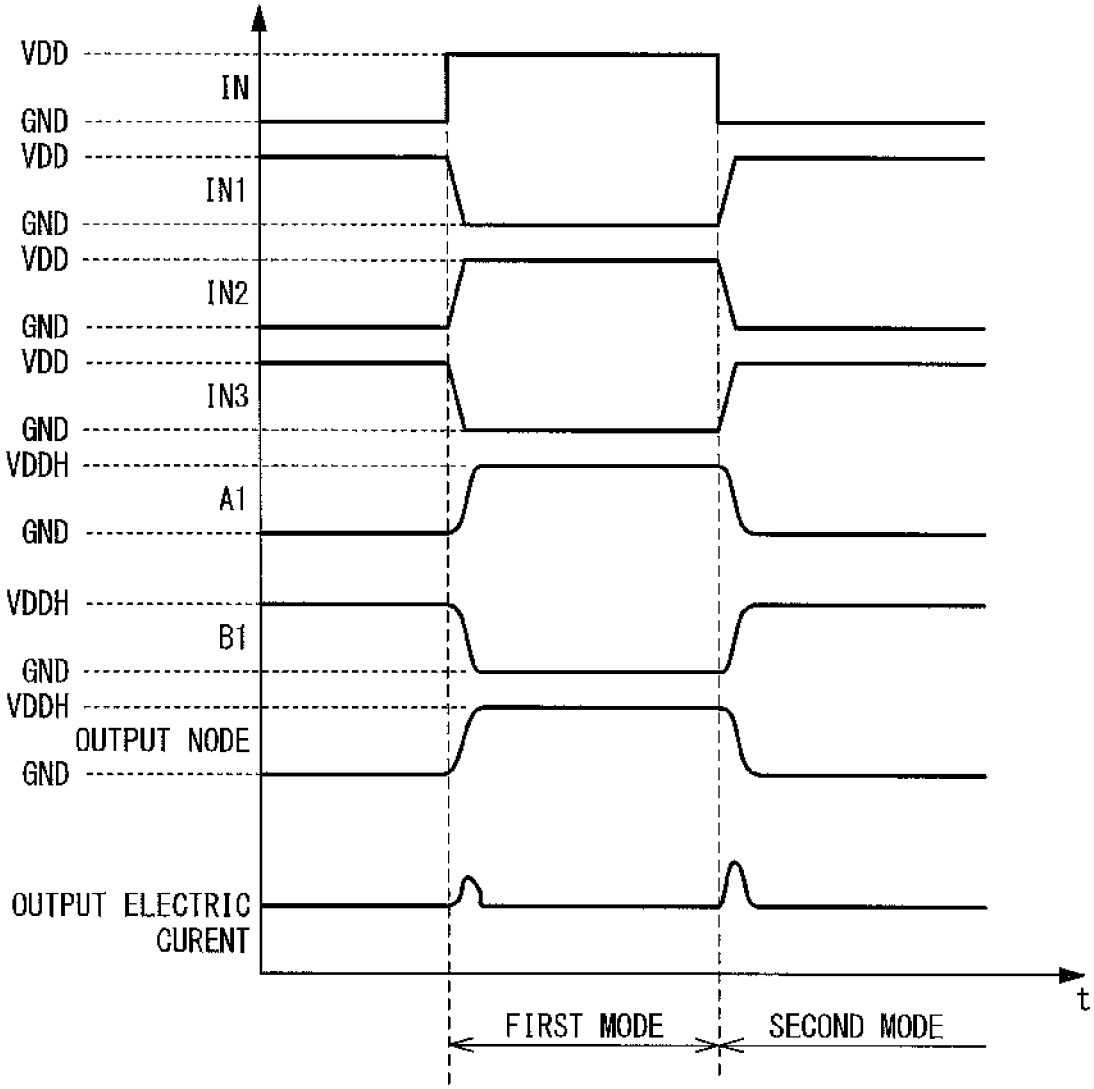
FIG. 7 shows timing charts of the operation of the drive circuit in two modes of an address period.

FIG. 7 shows the operation of the drive circuit 14 in first and second modes in the address period.

When the input signal IN is in a high level, the low voltage control section 13 executes the first mode. The input signal IN shows a data pulse voltage. The low voltage control section 13 sets the first to third input signals IN1 to IN3 to the low level, the high level and the low level in the first mode. That is, the second input signal IN2 has a polarity opposite to the polarity of the first input signal IN1 and the third input signal IN3 has a same polarity as that of the first input signal IN1.

In this case, the N-channel MOS transistor MN2 is turned on in response to the second input signal IN2 of the high level. Simultaneously, the N-channel MOS transistor MN1 is turned off in response to the first input signal IN1 of the low level. The P-channel MOS transistor MP3 is turned on in response to a voltage of the high level at the second node B1 (a second output signal). The P-channel MOS transistor MP2 is turned off in response to a voltage of the high level at the first node A1 (a first output signal). At this time, because the voltage of the second node B1 falls to the ground voltage GND, the P-channel MOS transistor MP1 and the P-channel MOS transistor MP4 for short-circuit current prevention is turned on approximately at the same time. Thus, the voltage of the output node OUT is raised to the first voltage VDDH. Also, the N-channel MOS transistor MN3 is turned off in response to the third input signal IN3 of the low level, so that the level of the input signal IN (data pulse voltage Vdp) is converted into a write level to the display cell 2 and is supplied to the data electrode D1 through the output node OUT.

On the other hand, when the input signal IN is in a low level, the low voltage control section 13 executes the second mode. The low voltage control section 13 sets the first to third input signals IN1 to IN3 to the high level, the low level and the high level in the second mode, respectively.

In this case, since the N-channel MOS transistor MN1 is turned on in response to the first input signal IN1 of the high level, so that the voltage of the first node A1 falls to the ground voltage GND. Thus, the P-channel MOS transistor MP2 is turned on in response to the voltage of the low level at the first node A1 (the first output signal). Simultaneously, since the N-channel MOS transistor MN2 is turned off in response to the second input signal IN2 of the low level, so that the voltage of the second node B1 is raised to the first voltage VDDH. Thus, the P-channel MOS transistor MP3 and the P-channel MOS transistor MP4 for short-circuit current prevention are turned off approximately at the same time. Moreover, the N-channel MOS transistor MN3 is turned on in response to the third input signal IN3 of the high level, so that the voltage of the output node OUT becomes the ground voltage GND.

It is assumed that the voltage of the output node OUT is rapidly reduced from the first voltage VDDH to the ground voltage GND when any fault such as a short-circuit has occurred in the first mode.

In this case, the voltage of the first node A1 is reduced simultaneously with the voltage of the output node OUT through the P-channel MOS transistor MP4 so that the P-channel MOS transistor MP2 is turned on. Since the P-channel MOS transistor MP2 is turned on, the P-channel MOS transistor MP3 is turned off. As a result, the voltage of the output node OUT is stable to the ground voltage GND so that the destruction of the P-channel MOS transistor MP3 can be prevented.

At this time, if the input signal IN2 is in the high level so that the N-channel MOS transistor MN2 holds an ON state, a path is formed from the first voltage VDDH to the ground voltage GND through the P-channel MOS transistor MP2 in the ON state and the N-channel MOS transistor MN2 in the ON state. Therefore, there is a possibility that the P-channel MOS transistor MP2 or the N-channel MOS transistor MN2 is destructed due to heat. In order to prevent this, the low voltage control section 13 executes the following third mode.

Figure 8:
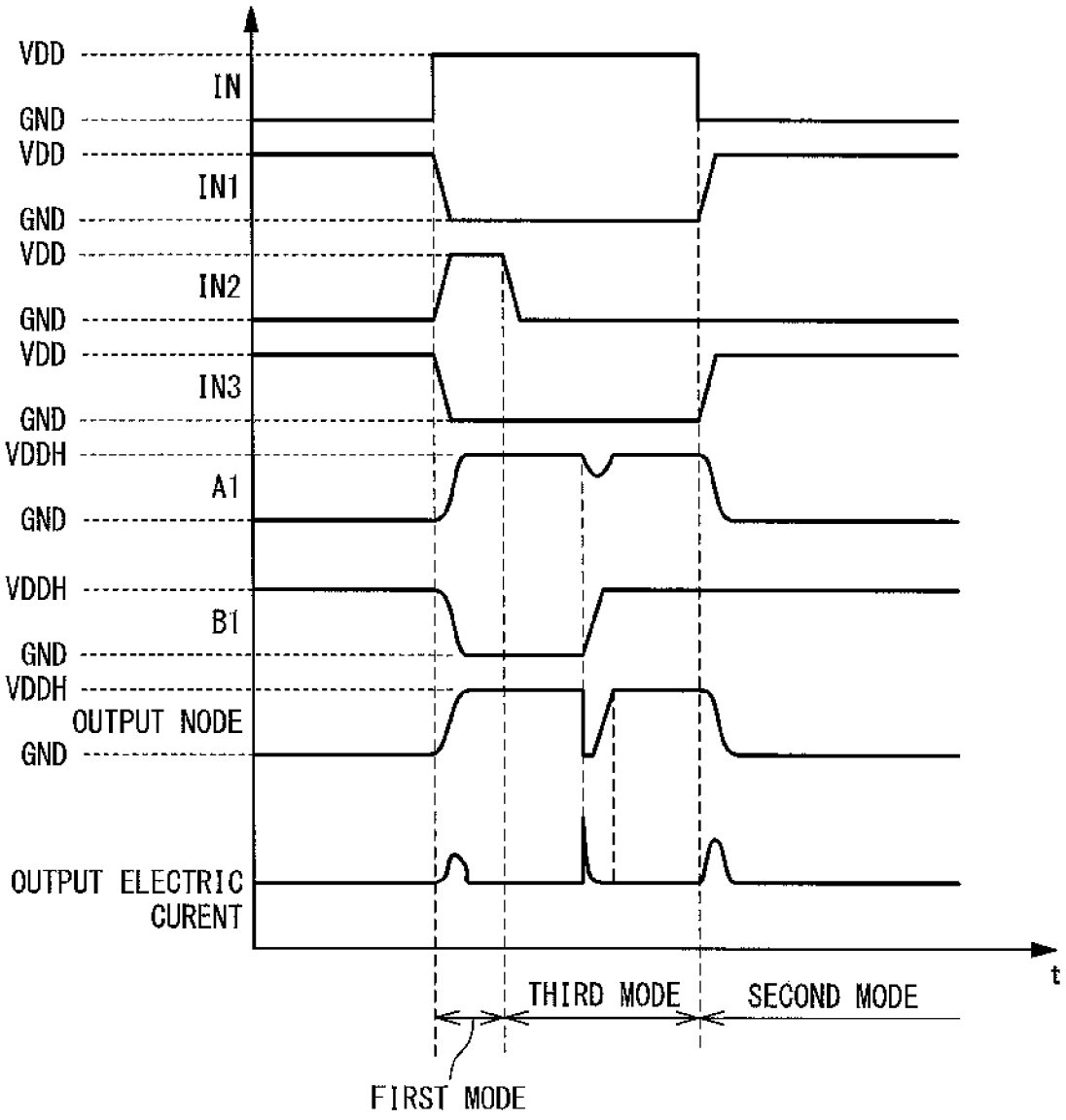
FIG. 8 shows timing charts the operation of the drive circuit in a third mode of the address period.

FIG. 8 shows the operation of the drive circuit 14 in a third mode in the address period.

The low voltage control section 13 executes the third mode between the first mode and the said second mode. Specifically, when the input signal IN is in the high level, the low voltage control section 13 executes the first mode only for a predetermined time period and then executes the third mode, so that current does not flow to pass through the P-channel MOS transistor MP2 and the N-channel MOS transistor MN2.

In the first mode, the low voltage control section 13 sets the first to third input signals IN1 to IN3 to the low level, the high level and the low level only for a predetermined time period. The predetermined time period represents a time period from when the N-channel MOS transistor MN2 is turned on in response to the second input signal IN2 in the high level such that the P-channel MOS transistor MP3 is turned on, to when the voltage at the third node C1 (the output node OUT) becomes sufficiently high. Thus, even if the input signal IN2 becomes the low level and the N-channel MOS transistor MN2 is turned off so that the gate of the P-channel MOS transistor MP3 is set to a high impedance state, the output terminal OUT can keep the high level and can prevent the output terminal OUT from being set to a middle voltage or the low level.

In the third mode, the low voltage control section 13 sets the first to third input signals IN1 to IN3 to the low level. That is, the low voltage control section 13 sets the signal level of the second input signal IN2 to the low level.

As described above, according to the drive circuit in the embodiment of the present invention, since the P-channel MOS transistor MP4 for short-circuit current prevention is provided between the first node A1 and the third node C1 (the output node OUT), even when the voltage of the output node OUT is rapidly reduced from the first voltage VDDH to the ground voltage GND due to a fault such as a short-circuit, the voltage of the first node A1 and the voltage of the output node OUT are reduced at the same time so that the P-channel MOS transistor MP2 is turned on. Thus, the P-channel MOS transistor MP3 is turned off. As a result, the voltage of the output node OUT is stable to the ground voltage GND to prevent the destruction of the P-channel MOS transistor MP3.

Also, according to the drive circuit in the embodiment of the present invention, the low voltage control section 13 executes the first mode only for the predetermined time period and then executes the third mode. Therefore, in addition to the above-described effect, a current can be prevented from flowing through the P-channel MOS transistor MP2 and the N-channel MOS transistor MN2.

Although the present invention has been described above in connection with several embodiments thereof, it would be apparent to those skilled in the art that those embodiments are provided solely for illustrating the present invention, and should not be relied upon to construe the appended claims in a limiting sense.

What is claimed is:

1. A drive circuit comprising:

first and second P-channel MOS transistors connected with a first voltage;

a first N-channel MOS transistor connected between said first P-channel MOS transistor and a second voltage which is lower than the first voltage, and having a gate configured to receive a first input signal, wherein a gate of said second P-channel MOS transistor is connected with a first node between said first P-channel MOS transistor and said first N-channel MOS transistor;

a second N-channel MOS transistor connected between said second P-channel MOS transistor and said second voltage and having a gate configured to receive a second input signal, wherein a gate of said first P-channel MOS transistor is connected with a second node between said second P-channel MOS transistor and said second N-channel MOS transistor;

an output P-channel MOS transistor connected between said first voltage and an output node and having a gate connected with said second node;

an output N-channel MOS transistor connected between said output node and said second voltage and having a gate supplied with an input signal having a same polarity as that of the first input signal; and a P-channel MOS transistor having a source connected directly to said first node, a drain connected directly to said output node, and a gate connected directly to said second node, wherein the P-channel MOS transistor is turned on and off according to a voltage of the second node.

2. The drive circuit according to claim 1, further comprising:

a low voltage control section configured to generate said first and second input signals in response to an input signal, wherein said low voltage control section executes first to third modes, wherein the first and second input signals are in a low level and a high level in the first mode when the input signal is in a first level; the first and second input signals are in the high level and the low level in the second mode when the input signal is in a second level opposite to the first level; and the first and second input signals are in the low level in the third mode.

3. The drive circuit according to claim 2, wherein said low voltage control section executes the third mode after executing the first mode for a predetermined time period when said input signal is in the first level.

4. The drive circuit according to claim 3, wherein said predetermined time period is from when said second N-channel MOS transistor is turned on in response to the high level of the second input signal to when a voltage of said output node approaches to the high level sufficiently.

5. A plasma display apparatus comprising:

a plurality of discharge electrode pairs, wherein one of each of said plurality of discharge electrode pairs is a maintenance electrode and the other is a scan electrode;

a plurality of data electrodes provided to oppose said plurality of discharge electrode pairs wherein display cells are formed at intersections of said plurality of discharge electrode pairs and said plurality of data electrodes;

a scan driver configured to drive said plurality of scan electrodes;

a maintenance driver configured to drive said plurality of maintenance electrodes; and a data driver configured to drive said plurality of data electrodes, wherein said data driver comprises:

an output control section configured to output a data pulse signal determined based on image data in an address period; and a drive circuit provided for each of said plurality of data electrodes, wherein said drive circuit comprises:

first and second P-channel MOS transistors connected with a first voltage;

a first N-channel MOS transistor connected between said first P-channel MOS transistor and a second voltage which is lower than the first voltage, and having a gate configured to receive a first input signal, wherein a gate of said second P-channel MOS transistor is connected with a first node between said first P-channel MOS transistor and said first N-channel MOS transistor;

a second N-channel MOS transistor connected between said second P-channel MOS transistor and said second voltage and having a gate configured to receive a second input signal, wherein a gate of said first P-channel MOS transistor is connected with a second node between said second P-channel MOS transistor and said second N-channel MOS transistor;

an output P-channel MOS transistor connected between said first voltage and an output node and having a gate connected with said second node;

an output N-channel MOS transistor connected between said output node and said second voltage and having a gate supplied with an input signal having a same polarity as that of the first input signal; and a P-channel MOS transistor having a source connected directly to said first node, a drain connected directly to said output node, and a gate connected directly to said second node, wherein the P-channel MOS transistor is turned on and off according to a voltage of the second node, and wherein said first and second input signals are generated based on the data pulse signal as an input signal.

6. The plasma display apparatus according to claim 5, further comprising a control section, wherein said control section:

in a reset period, controls said maintenance driver and said scan driver to supply voltages corresponding to electric charge accumulated during maintenance discharge to adjust between said plurality of maintenance electrodes and said plurality of scan electrodes to said plurality of maintenance electrodes and said plurality of scan electrodes, in said address period after said reset period, controls said maintenance driver, said scan driver, and said data driver to supply voltages for write discharge to write the image data in said display cells to said plurality of maintenance electrodes, said plurality of scan electrodes, and said plurality of data electrodes, respectively, and in a maintenance period after said address period, controls said maintenance driver and said scan driver to supply voltages for maintenance discharge between said plurality of scan electrodes and said plurality of maintenance electrodes to said plurality of maintenance electrodes and said plurality of scan electrodes, respectively.

7. The plasma display apparatus according to claim 5, wherein said control section:

in said address period, controls said maintenance driver to supply a first setting voltage to said plurality of maintenance electrodes, controls said scan driver to sequentially supply a scan pulse voltage, which falls from a second setting voltage to said second voltage, to said plurality of scan electrodes, after supplying said second setting voltage, which is higher than said second voltage, to said plurality of scan electrodes, and controls said data driver to supply said data pulse signal to said plurality of data electrodes.

* * * * *